US006109670A

United States Patent [19]

Tomaszewski et al.

[11] Patent Number: 6,109,670

[45] Date of Patent: Aug. 29, 2000

[54] VEHICLE HOOD LATCH WITH RETRACTING SECONDARY RELEASE ARM

[75] Inventors: Kris Tomaszewski, Markham; Grzegorz Baniak, Etobicoke, both of Canada

[73] Assignee: Atoma International Corp., Newmarket, Canada

[21] Appl. No.: 09/148,651

[22] Filed: Sep. 4, 1998

Related U.S. Application Data

[60] Provisional application No. 60/064,863, Sep. 4, 1997.

[51] Int. Cl.[7] ..... F05C 3/06

[52] U.S. Cl. ..... 292/216; 292/DIG. 14; 292/DIG. 62

[58] Field of Search ..... 292/201, 216, 292/DIG. 14, 26, DIG. 62, DIG. 43, DIG. 23, 223

[56] References Cited

U.S. PATENT DOCUMENTS

| | | | |
|---|---|---|---|
| 2,729,487 | 1/1956 | Krause et al. | 292/DIG. 14 X |
| 2,781,214 | 2/1957 | Claud-Mantle | 292/DIG. 14 R X |
| 3,743,335 | 7/1973 | Reilhac et al. | 292/127 |
| 3,749,434 | 7/1973 | Gley | 292/128 |
| 3,905,624 | 9/1975 | Fujita | 292/11 |
| 4,756,562 | 7/1988 | Foster et al. | 292/28 |
| 4,961,601 | 10/1990 | Lindholm et al. | 292/216 |
| 4,991,884 | 2/1991 | Cairns | 292/28 |
| 5,000,493 | 3/1991 | Bastien | 292/11 |
| 5,141,265 | 8/1992 | Claar et al. | 292/30 |
| 5,150,933 | 9/1992 | Myslicki et al. | 292/216 |
| 5,738,393 | 4/1998 | Chao | 292/216 |

FOREIGN PATENT DOCUMENTS

| | | | |
|---|---|---|---|
| 1287 170 | 1/1962 | France | 292/DIG. 14 |
| 263 6827 | 7/1977 | Germany | 292/DIG. 14 |
| 232 487 | 9/1990 | Japan | 292/DIG. 14 |

*Primary Examiner*—B. Dayoan
*Assistant Examiner*—Clifford B Vaterlaus
*Attorney, Agent, or Firm*—Howard & Howard

[57] ABSTRACT

A secondary release mechanism for a vehicle hood latch has a pivotally mounted secondary latch which is rotatable between a latching position and a unlatching position and biased towards the latching position. A pivotally mounted release arm is rotatable between a retracted position, a deployed position and a releasing position and biased to the standby position. A pivotally mounted release lever is rotatable between a release position, a standby position and a retract position. The release lever has a cam surface for engaging a hood of the vehicle as the hood moves between the fully latched condition and a secondary latched condition responsively rotating the release lever between the standby position and the retract position. The release lever operably engages the secondary latch as the release lever rotates from the standby position to the release position. The release arm engages the release lever wherein responsive movement of the release lever between the standby position to the retract position responsively effects movement of the release arm between the deployed position and the retracted position and movement of the release arm from the deployed position to the releasing position responsively effects movement of the release lever rotating the secondary latch from the latching position to the unlatching position.

19 Claims, 3 Drawing Sheets

VEHICLE HOOD LATCH WITH RETRACTING SECONDARY RELEASE ARM

This application claims priority to Provisional Application No. 60/064,863 which was filed on Sep. 4, 1997.

FIELD OF INVENTION

This invention relates to a hood latch for a vehicle. In particular, this invention relates to a hood latch having a retracting secondary arm.

BACKGROUND OF INVENTION

Vehicle hood latch systems are well known in the art. Typically, a vehicle hood or trunk deck will have a latch for engaging and cinching onto a striker. The latch will have a rotatably mounted ratchet or detent fork engaging a pawl in a ratchet relation. The detent fork cooperates with a mouth of the housing to pivot between an open and closed condition for receiving, engaging and cinching a keeper of a striker. The pawl retains the detent fork in the closed and cinched conditions.

Hood latches are required to have a secondary latching mechanism and a primary latching mechanism. The primary latching mechanism is operably from inside the vehicle, normally under the dashboard. A secondary latching is only operable from the outside. The secondary release lever is accessible only after the primary latching mechanism has been deployed, but is usually in a deployable position even though it is not accessible. In many cases, the location of the arm is difficult to find requiring the operator to probe blindly or bend over to look for the arm.

It is known to provide a release lever on the secondary latching mechanism which is presented only upon the release of the primary latch. Examples of such latch mechanism are described in U.S. Pat. Nos. 4,961601; 4,991,884; 5,000,493 and 5,141,265. However, such mechanisms require complicated linkages and levers, adding costs to the latch. As a result, the use of self presenting secondary release arms has been limited.

SUMMARY OF THE INVENTION

The disadvantages of the prior art may be overcome by providing a hood latch assembly for a vehicle having a simple mechanism for self presenting a secondary release arm upon releasing of the primary release and which retracts upon closure of the hood.

According to one aspect of the invention, there is provided a secondary release mechanism for a vehicle hood latch has a pivotally mounted secondary latch which is rotatable between a latching position and a unlatching position and biased towards the latching position. A pivotally mounted release arm is rotatable between a retracted position, a deployed position and a releasing position and biased to the standby position. A pivotally mounted release lever is rotatable between a release position, a standby position and a retract position. The release lever has a cam surface for engaging a hood of the vehicle as the hood moves between the fully latched condition and a secondary latched condition responsively rotating the release lever between the standby position and the retract position. The release lever operably engages the secondary latch as the release lever rotates from the standby position to the release position. The release arm engages the release lever wherein responsive movement of the release lever between the standby position to the retract position responsively effects movement of the release arm between the deployed position and the retracted position and movement of the release arm from the deployed position to the releasing position responsively effects movement of the release lever rotating the secondary latch from the latching position to the unlatching position.

According to another aspect of the invention, there is provided a hood latch assembly having a housing having a mouth. A detent fork providing a primary engagement is pivotally mounted within the housing to cooperate with the mouth to pivot between an open and closed condition for receiving, engaging and cinching a keeper of a striker. The detent fork is biased in the open condition. A pivotally mounted pawl is biased for engagement with the detent fork to retain the detent fork in the closed condition. A secondary latch is pivotally mounted to engage the keeper of the striker upon release of the detent fork. The secondary latch is biased to engage the keeper. A release lever is pivotally mounted to engage the keeper of the striker as the latch engages and cinches the keeper. The release lever responsively rotates between a release position, a standby position and a retract position. The release lever is optionally biased to the standby position. The release lever has an abutment for engaging the secondary latch when rotating is a releasing sense. A secondary release arm is pivotally mounted and cooperates with the release lever. The secondary release arm is rotatable between a releasing position, a deployed position and a retracted position and center biased to the deployed position and to engage the release lever. As the detent fork engages the keeper, the keeper will engage the release lever rotating it in a retracting sense, opposite the releasing sense, from the standby position to the retract position. The release lever urges the secondary release arm to rotate from the deployed position to the retracted position. Once the detent fork is fully engaged providing primary engagement, the secondary release arm is fully retracted.

Upon release of the primary engagement, the keeper will move relative to the latch allowing the release lever to rotate in the releasing sense, allowing the bias of the secondary release arm to rotate the secondary release arm from the retracted position to the deployed position, positioned for activation of the release of the secondary latch. Over rotating the secondary release arm urges the release lever to over rotate in the releasing sense which urges the secondary latch to rotate in a releasing sense to release the keeper. Upon releasing the secondary release arm, the bias of the secondary latch will return the secondary latch and the release lever to the respective standby positions. The center bias of the secondary release arm returns the secondary release arm to the deployed position.

DESCRIPTION OF THE DRAWINGS

In drawings which illustrate embodiments of the invention.

DESCRIPTION OF THE INVENTION

Figure 1:
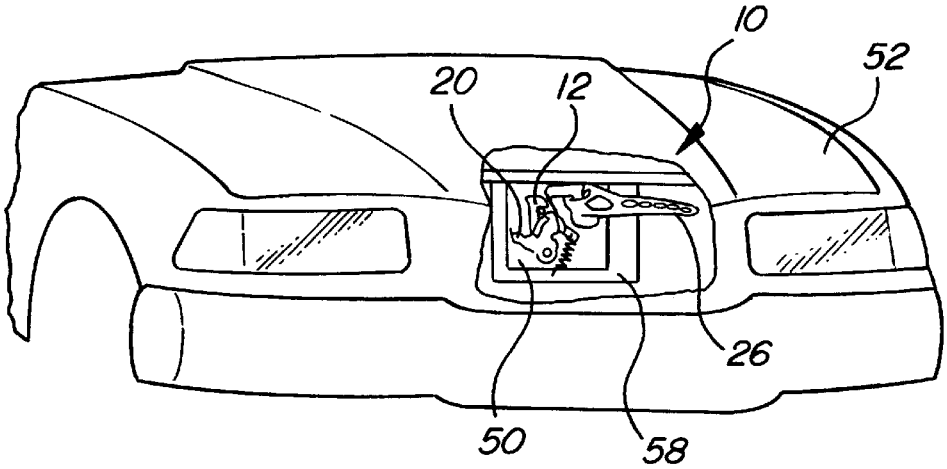
FIG. 1 is a perspective view front end of a vehicle incorporating a latch assembly of the present invention, with the release arm in a retracted position.
Figure 2:
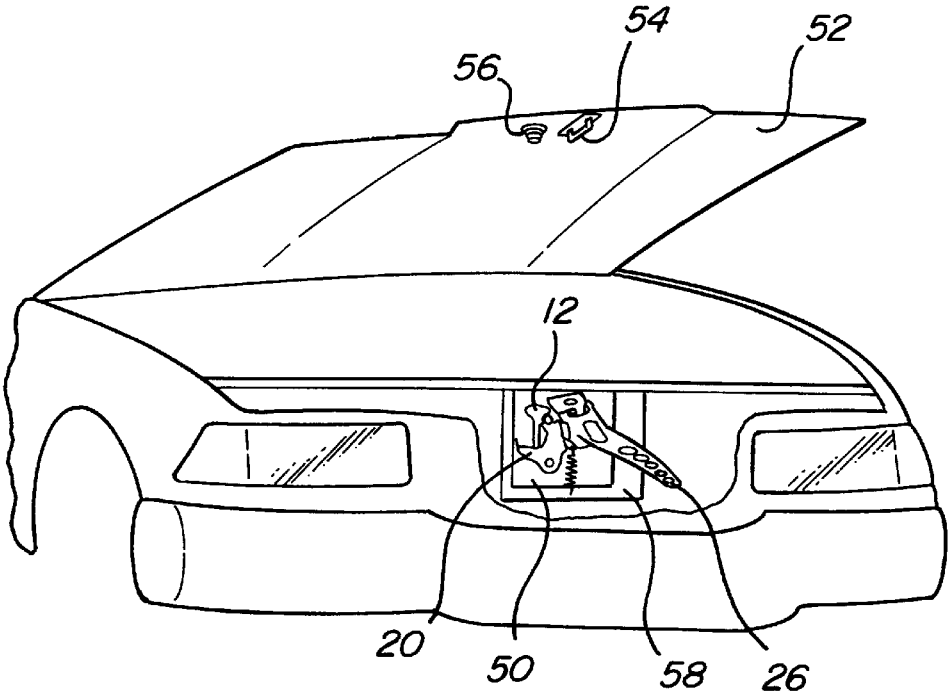
FIG. 2 is a perspective view of the vehicle of FIG. 1, with the hood opened and the release arm in a deployed position.

The secondary release mechanism 10 of the present invention is generally illustrated in FIGS. 1 and 2. The secondary release mechanism 10 can be used in conjunction with a conventional primary hood latch assembly 50 such as those found on a minivan.

The vehicle has a hood 52 pivotally mounted for movement between an open and closed condition. Latch assembly 50 retains the hood 52 in the closed condition in a manner well known in the art. The hood 52 has a striker 54 having keepers 16. Spring 56 biases the hood 52 towards the open condition.

The secondary release mechanism 10 is preferably mounted on the hood latch assembly 50 which is mounted on a mounting plate 58 affixed to the frame of the vehicle.

Figure 3:
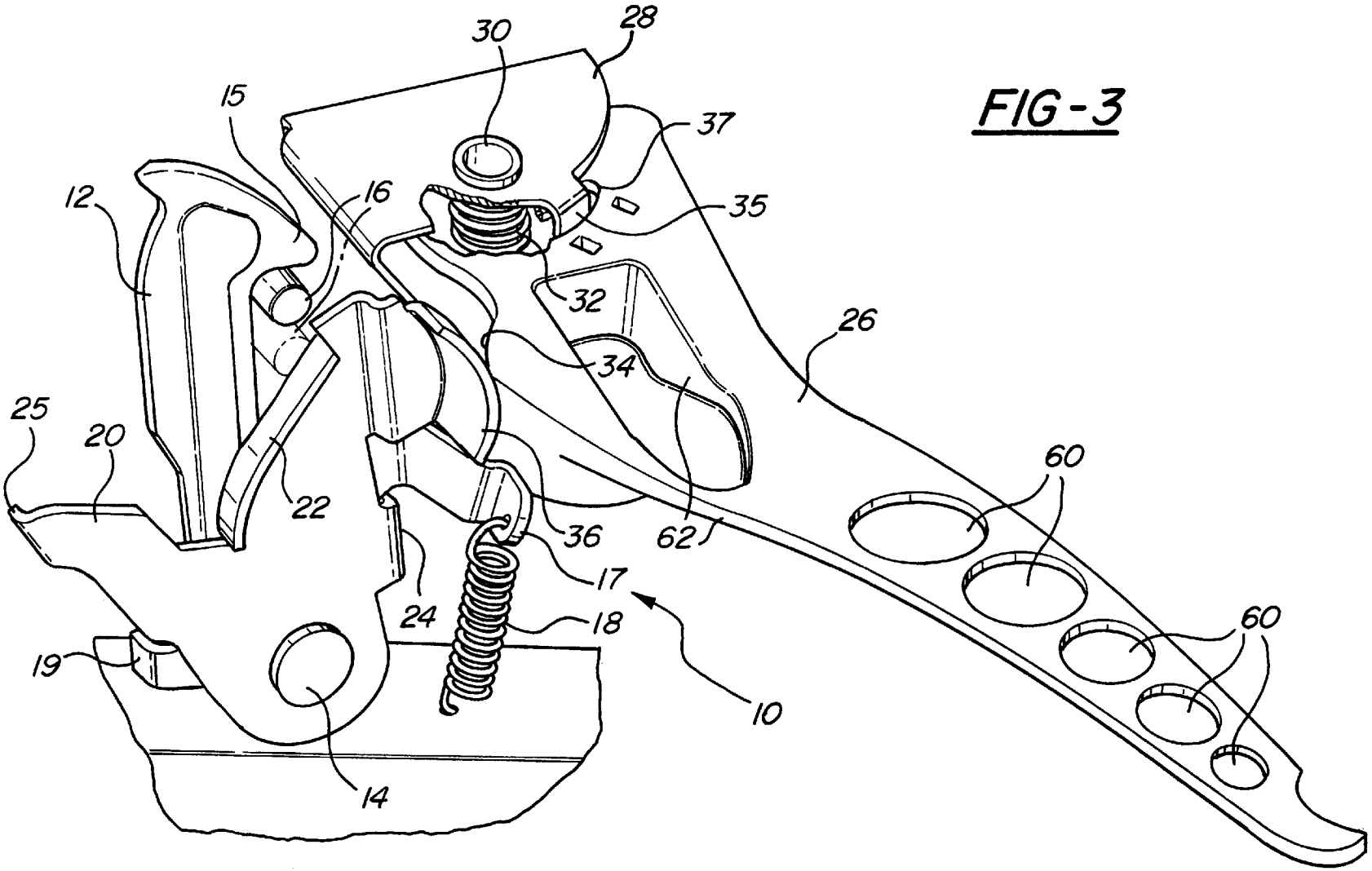
FIG. 3 is a detailed perspective view of the latch assembly of the present invention.
Figure 4:
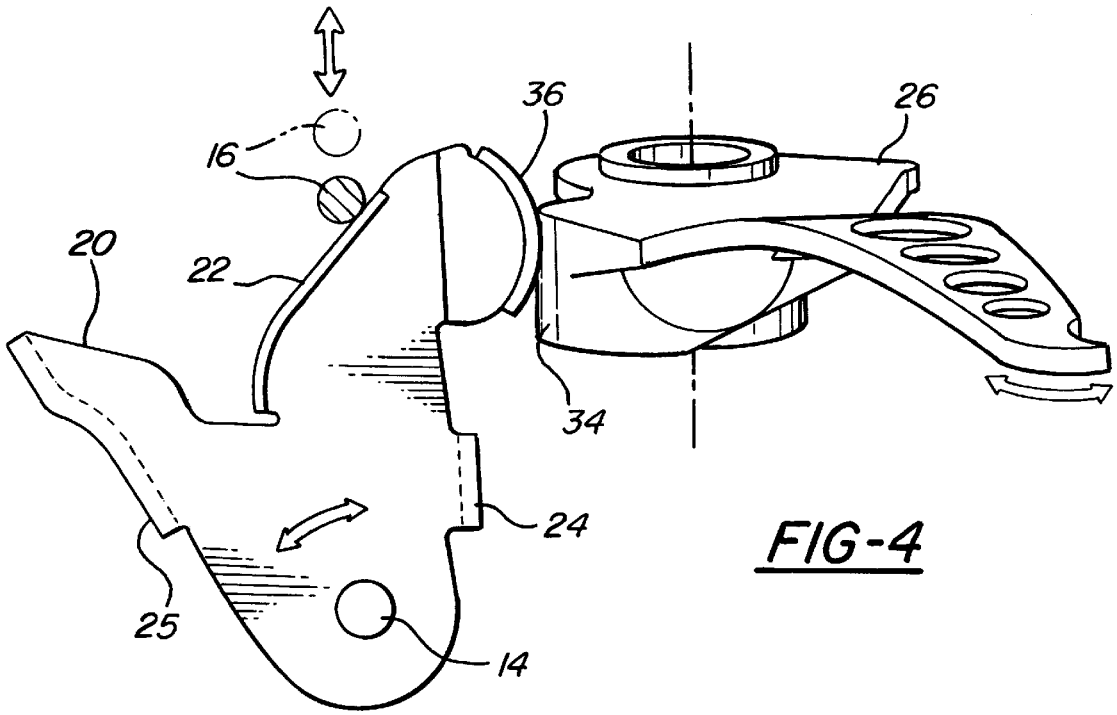
FIG. 4 is an elevational view of the release lever and secondary release arm of the embodiment of FIG. 3.
Figure 5:
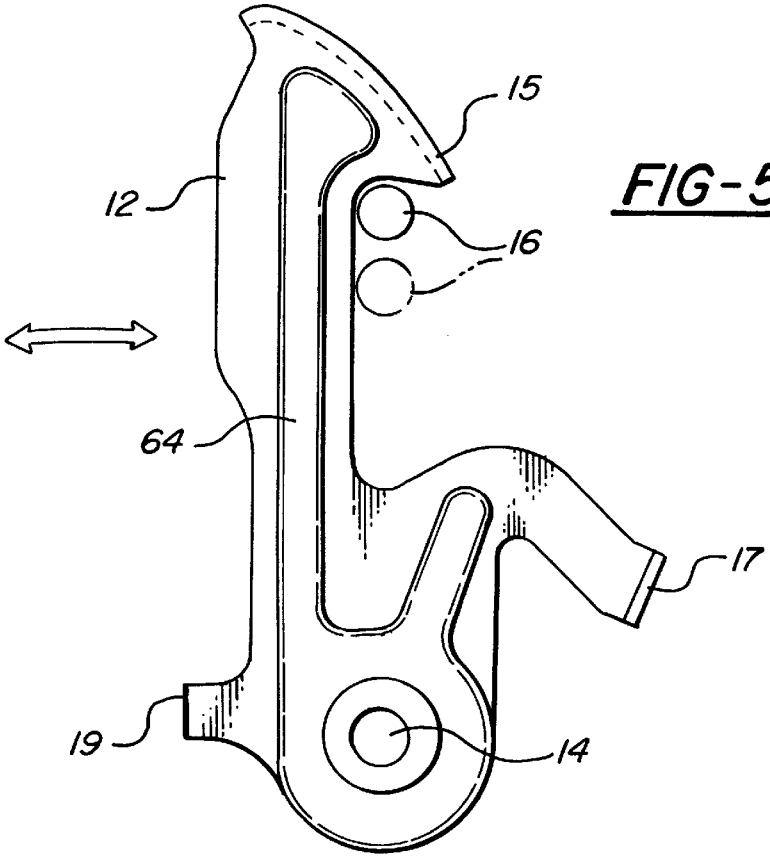
FIG. 5 is an elevational view of the secondary latch of the embodiment of FIG. 3.

Referring to FIG. 3, the secondary release mechanism 10 generally has a secondary latch 12 which has a hook or latching end 15 and which is rotatable mounted on a pin 14 to pivot between an unlatching position and a latching position to grip and unlatch keepers 16 of striker 54. Tab 19 extends towards the mounting bracket and engages a corresponding slot which limits travel of the secondary latch 12 at the unlatching and latching positions. Spring 18 attaches between a base structure such as a housing or mounting bracket of the latch assembly 50 and at tab 17 of secondary latch 12 to bias secondary latch 12 to a latching position.

Release lever 20 is pivotally mounted on pin 14 to pivot between a release position, a standby position and a retract position. Preferably, release lever 20 is commonly mounted on the same pin as the secondary latch 12. The release lever 20 may be optionally center biased to the standby position by spring 21. Release lever 20 has a cam surface 22 which is positioned to engage keeper 16 of the striker. The release lever 20 has a flange 24 and a flange 25 extending towards the secondary latch 12 which is nested therein for engaging and cooperating therewith in a lost motion relationship. Release lever 20 rotates relative to the secondary latch 12 between flanges 24 and 25. Thus, the release lever 20 is permitted limited rotation relative to the secondary latch 12 and will have limited cooperative rotation therewith. When release lever 20 rotates in a releasing sense from the standby position to the release position, the secondary latch 12 rotates from the latching position to the unlatching position. Release lever 20 rotates independently from the secondary latch 12 when the release lever 20 rotates from the standby position to the retract position.

A secondary release arm 26 is pivotally mounted on bracket 28 at pin 30. The axis of rotation of the secondary release arm 26 is preferably oriented orthogonally to the axis of rotation of the secondary latch 12 and the release lever 20. Bracket 28 may be integrated with the conventional latch housing or mounting bracket with which the secondary release mechanism 10 cooperates. Preferably, secondary release mechanism 10 is mounted on a common bracket with the hood latch mechanism 50 on opposite sides thereof. Optionally, bracket 28 may be mounted directly onto the vehicle and positioned to cooperate with the secondary release lever 20.

The secondary release arm 26 is rotatable between a releasing position, a deployed position and a retracted position. The release arm 26 extends forwardly when in the deployed position, such that a user may manipulate the release arm from between the partially open hood and the vehicle. In the retracted position, the release arm 26 extends at an angle to the longitudinal axis of the vehicle. It is not essential that the release arm 26 fully retract to extend transversely of the vehicle, only that the release arm 26 retract to not interfere with the opening and closing of the hood 52.

Secondary release arm 26 is center biased by spring 32 to the deployed position. Secondary release arm 26 has a second abutment surface 34 which is preferably a lobe 34 with an arcuate circumference. Lobe 34 engages a first abutment surface 36 of the release lever 20 which is preferably an arcuate flange 36 on release lever 20. Bracket 28 has a tab 35 extending parallel to the pin 30. Secondary release arm 26 has an arcuate slot 37 having an arcuate length corresponding to the arcuate length between the retracted position and the release position. Tab 35 travels within slot 37 to guide the pivoting movement of the secondary release arm 26.

Preferably, the various components which comprise the secondary latch mechanism can be manufactured from stamped metal and then assembled in a conventional manner. Secondary release arm 26 preferably has a plurality of apertures 60 for reducing the weight thereof. Ribs 62 are provided on the underside of secondary release arm 26 to increase strength and rigidity. Alternatively, secondary release arm 26 can be manufactured from a high strength light weight plastic material. Embossed ribbing 64 on secondary latch 12 is preferably formed during stamping to increase strength and rigidity.

Upon closing a hood, the keeper 16 will engage secondary latch 12 at latching end 15. The closing action will deflect the secondary latch 12 from the latching position to the unlatching position. The keeper 16 will pass the secondary latch 12 engaging the release lever 20 rotating it in a retracting sense, opposite the releasing sense, from the standby position to the retract position, until finally the keeper 16 engages the detent fork of the conventional latch to secure the hood 52 in a primary latched condition. Flange 36 of the release lever 20 responsively pushes on lobe 34 of the secondary release arm 26 rotating the secondary release arm 26 from the deployed position to the retracted position. Once the detent fork is fully engaged providing primary engagement, the secondary release arm 26 is fully retracted.

Upon release of the primary engagement of the conventional latch 50, the keeper 16 will move upwardly and engage the underside of latching end 15, moving from the primary or fully latched condition to the secondary latched condition. The cam surface 22 of release lever 20 will follow the keeper 16 allowing the release lever 20 to rotate in the releasing sense from the retract position to the standby position. The bias of the secondary release arm 26 will rotate the secondary release arm 26 from the retracted position to the deployed position, substantially perpendicular to the general plane of secondary latch 12, positioned for activation of the secondary latch 12. Over-rotating the secondary release arm 26 in response to manual manipulation, urges the release lever 20 to over-rotate in the releasing sense from the standby position to the release position which urges the secondary latch 12 to rotate in a releasing sense to release the keeper 16 and allowing the hood 52 to be opened. Upon releasing the secondary release arm 26, the bias of the secondary latch 12 will return the secondary latch 12 and the release lever 20 to the respective standby positions. The center bias of spring 32 returns the secondary release arm 26 to the deployed position.

The preceding specific embodiment is illustrative of the practice of the present invention. It is to be understood, however, that other expedients known or apparent to those skilled in the art or disclosed herein may be employed without departing from the spirit and scope of the invention.

We claim:

1. A secondary release mechanism for a vehicle hood latch having a primary release mechanism for securing a pivotally mounted hood in a latched condition, said secondary release mechanism comprising:

a pivotally mounted secondary latch rotatable between a latching position and a unlatching position and biased towards the latching position, a pivotally mounted release arm rotatable between a retracted position, a deployed position and a releasing position and biased to said deployed position, a pivotally mounted release lever rotatable between a release position, a standby position and a retract position, said release lever having a cam surface for engaging the hood as the hood moves between the latched condition and a secondary latched condition which responsively rotates the release lever between the standby position and the retract position, and said release lever operably engages the secondary latch as the release lever rotates from the standby position to the release position, said release lever including a first abutment surface and said release arm including a second abutment surface in co-acting relationship with said first abutment surface, such that said movement of the release lever between the standby position to the retract position engages said first abutment surface with said second abutment surface to responsively effect said movement of the release arm between the deployed position and the retracted position, and said movement of the release arm from the deployed position to the releasing position engages said second abutment surface with said first abutment surface to responsively effect said movement of the release lever from said standby position to said release position and rotate the secondary latch from the latching position to the unlatching position.

2. A secondary release mechanism as claimed in claim 1 wherein said secondary latch and said release lever are coaxially mounted on a common pivot.

3. A secondary release mechanism as claimed in claim 2 wherein said release arm has an axis of rotation orthogonal to said common pivot.

4. A secondary release mechanism for a vehicle hood latch having a primary release mechanism for securing a pivotally mounted hood in a fully latched condition, said secondary release mechanism comprising:

a pivotally mounted secondary latch rotatable between a latching position and a unlatching position and biased towards the latching position, a pivotally mounted release arm rotatable between a retracted position, a deployed position and a releasing position and biased to said deployed position, a pivotally mounted release lever rotatable between a release position, a standby position and a retract position, said release lever having a cam surface for engaging the hood as the hood moves between the fully latched condition and a secondary latched condition which responsively rotates the release lever between the standby position and the retract position, and a lost motion connection between the release lever and the secondary latch for limited rotational movement therebetween and limited cooperative movement thereof, said release lever including a first abutment surface and said release arm including a second abutment surface in co-acting relationship with said first abutment surface, such that independent movement of the release lever between the standby position and the retract position engages said first abutment surface with said second abutment surface to responsively effect said movement of the release arm between the deployed position and the retracted position, and said movement of the release arm from the deployed position to the releasing position engages said second abutment surface with said first abutment surface to responsively effect said cooperative movement of the release lever and the secondary latch to rotate the secondary latch from the latching position to the unlatching position.

5. A secondary release mechanism as claimed in claim 4 wherein said secondary latch and said release lever are coaxially mounted on a common pivot.

6. A secondary release mechanism as claimed in claim 5 wherein said release arm has an axis of rotation orthogonal to said common pivot.

7. A secondary release mechanism as claimed in claim 6 wherein said release lever has two flanges for limiting rotational travel relative to the secondary latch.

8. A secondary release mechanism for a vehicle hood latch having a primary release mechanism for securing a pivotally mounted hood in a latched condition, said secondary release mechanism comprising:

a pivotally mounted secondary latch rotatable between a latching position and a unlatching position;

a first spring biasing said secondary latch towards the latching position, a pivotally mounted release arm rotatable between a retracted position, a deployed position and a releasing position;

a second spring biasing the release arm to the standby position, and a pivotally mounted release lever rotatable between a release position, a standby position and a retract position, said release lever having a cam surface for engaging the hood as the hood moves between the latched condition and a secondary latched condition which responsively rotates the release lever between the standby position and the retract position, and said release lever operably engages the secondary latch as the release lever rotates from the standby position to the release position, said release lever including a first abutment surface and said release arm including a second abutment surface in co-acting relationship with said first abutment surface, such that said movement of the release lever between the standby position to the retract position engages said first abutment surface with said second abutment surface to responsively effect said movement of the release arm between the deployed position and the retracted position, and said movement of the release arm from the deployed position to the releasing position engages said second abutment surface with said first abutment surface to responsively effect said movement of the release lever from said standby position to said release position and rotate the secondary latch from the latching position to the unlatching position.

9. A secondary release mechanism as claimed in claim 8 wherein said secondary release mechanism further includes a third spring biasing said release lever to engage said release arm.

10. A secondary release mechanism as claimed in claim 9 wherein said secondary latch and said release lever are coaxially mounted on a common pivot.

11. A secondary release mechanism as claimed in claim 10 wherein said release arm has an axis of rotation orthogonal to said common pivot.

12. A secondary release mechanism as claimed in claim 11 wherein said release lever has two flanges for limiting rotational travel relative to the secondary latch.

13. A secondary release mechanism as claimed in claim 12 wherein said secondary latch, said release arm and said release lever are mounted on a common bracket and a hood latch is mounted on an opposite side of the common bracket.

14. A secondary release mechanism as claimed in claim 1 wherein said first abutment surface is further defined as an arcuate flange extending outwardly from said release lever.

15. A secondary release mechanism as claimed in claim 14 wherein said second abutment surface is further defined as a lobe extending outwardly from said release arm and at least partially aligned with said arcuate flange.

16. A secondary release mechanism as claimed in claim 4 wherein said first abutment surface is further defined as an arcuate flange extending outwardly from said release lever.

17. A secondary release mechanism as claimed in claim 16 wherein said second abutment surface is further defined as a lobe extending outwardly from said release arm and at least partially aligned with said arcuate flange.

18. A secondary release mechanism as claimed in claim 8 wherein said first abutment surface is further defined as an arcuate flange extending outwardly from said release lever.

19. A secondary release mechanism as claimed in claim 18 wherein said second abutment surface is further defined as a lobe extending outwardly from said release arm and at least partially aligned with said arcuate flange.

* * * * *